US010492651B2

(12) United States Patent
Chaffin

(10) Patent No.: US 10,492,651 B2
(45) Date of Patent: Dec. 3, 2019

(54) BAGLESS VACUUM CLEANER

(71) Applicant: Dustin Chaffin, West Jordan, UT (US)

(72) Inventor: Dustin Chaffin, West Jordan, UT (US)

( * ) Notice: Subject to any disclaimer, the term of this patent is extended or adjusted under 35 U.S.C. 154(b) by 69 days.

(21) Appl. No.: 15/592,141

(22) Filed: May 10, 2017

(65) Prior Publication Data

US 2017/0238773 A1 Aug. 24, 2017

Related U.S. Application Data

(63) Continuation of application No. 14/877,890, filed on Oct. 7, 2015, now Pat. No. 9,675,219, which is a continuation-in-part of application No. 14/686,881, filed on Apr. 15, 2015, now abandoned.

(51) Int. Cl.

| | |
|---|---|
| ***A47L 5/36*** | (2006.01) |
| ***A47L 9/32*** | (2006.01) |
| ***A47L 9/12*** | (2006.01) |
| ***A47L 9/16*** | (2006.01) |
| ***A47L 9/22*** | (2006.01) |

(52) U.S. Cl.

CPC ..... *A47L 5/365* (2013.01); *A47L 5/36* (2013.01); *A47L 9/12* (2013.01); *A47L 9/165* (2013.01); *A47L 9/1608* (2013.01); *A47L 9/1683* (2013.01); *A47L 9/22* (2013.01); *A47L 9/322* (2013.01)

(58) Field of Classification Search

CPC ... A47L 5/365; A47L 5/36; A47L 9/12; A47L 9/1608; A47L 9/165; A47L 9/1683; A47L 9/22; A47L 9/322

See application file for complete search history.

(56) References Cited

U.S. PATENT DOCUMENTS

| | | | | |
|---|---|---|---|---|
| 6,553,610 | B1 * | 4/2003 | Shideler | A47L 5/36 15/327.5 |
| 8,943,647 | B1 * | 2/2015 | Henderson | A47L 5/225 15/328 |
| 2014/0096339 | A1 * | 4/2014 | Niederman | A47L 5/36 15/327.5 |
| 2014/0101889 | A1 * | 4/2014 | Davidshofer | A47L 9/1608 15/353 |
| 2014/0259513 | A1 * | 9/2014 | Conrad | A47L 5/225 15/320 |
| 2015/0020345 | A1 * | 1/2015 | Day | A47L 5/24 15/347 |

* cited by examiner

*Primary Examiner* — Dung Van Nguyen

(57) ABSTRACT

A canister vacuum cleaner is disclosed, which includes an exterior casing that has a top half and a bottom half. An interior area of the bottom half of the casing houses a motor that is configured to generate a suction force, which is ultimately transmitted through a tube and an appended flexible hose. By positioning the motor at the bottom half of the casing, the vacuum cleaner exhibits a more preferred and ergonomic center of gravity. The canister vacuum cleaner is bagless—and does not require the use of a disposable bag to capture and retain dirt and debris that the vacuum cleaner extracts from the environment. In some cases, the vacuum cleaner utilizes a first, second, and third means for cyclonic separation of dirt and debris.

8 Claims, 12 Drawing Sheets

BAGLESS VACUUM CLEANER

CROSS-REFERENCE TO RELATED APPLICATIONS

This application is a continuation of U.S. patent application Ser. No. 14/877,890, filed Oct. 7, 2015, which is a continuation-in-part of U.S. patent application Ser. No. 14/686,881, filed Apr. 15, 2015.

FIELD OF THE INVENTION

The field of the present invention relates to vacuum cleaners and, in certain embodiments, to the field of bagless vacuum cleaners.

BACKGROUND OF THE INVENTION

Over the years, various types of vacuum cleaners have been designed and commercially deployed. Many vacuum cleaners include a base portion that rolls or glides across a floor surface, which comprises a suction functionality and is configured to extract dirt and debris from the floor surface. These vacuum cleaners will often further include an upright section that houses one or more filters and a disposable bag, which are configured to capture and retain the dirt and debris that the base portion extracts from the floor surface. The upright section is typically pivotally attached to the base portion, with a handle located at the topmost portion, which may be gripped and used to push the vacuum clear across the floor surface. While these standard vacuum cleaners are often effective, they are typically large in size and more difficult to maneuver, which renders such vacuums less suitable for cleaning hard-to-reach surfaces (or smaller areas where it may be difficult to navigate such vacuum cleaners).

In other examples, vacuum cleaners may be configured as canister vacuum cleaners, which are typically smaller in size. A canister vacuum cleaner will often comprise a rigid outer exterior that houses a motor to create a suction force, as well as a means for filtering and retaining dirt and debris that are removed (suctioned) from a floor surface. The rigid outer exterior portion (the casing) is often configured with a set of wheels, which allow the vacuum cleaner to be pulled to different areas of a room during use. These vacuum cleaners will include an air entry port that is connected to a hose. The distal portion of the hose (opposite of the end that is attached to the air entry port) may be adapted to receive one or more accessories, which are configured to clean different types of surfaces. With these canister vacuums, dirt and debris laden air is sucked through the distal end of the hose, which then travels through the hose and into the canister portion of the vacuum cleaner where the air is filtered and allowed to subsequently exit the vacuum cleaner (leaving behind the filtered dirt/debris in a disposable bag).

Although these vacuum cleaners are routinely used today, a continuing need exists for vacuum cleaners that exhibit enhanced portability features, e.g., vacuum cleaners that can be worn, such that a user may easily carry the vacuum cleaner to different parts of a room or other area during use (instead of pulling or pushing the entire vacuum across the floor). In addition, it would be advantageous to provide a vacuum cleaner that is more ergonomic (and easier to carry) than other currently-available vacuum cleaners that may be worn on a person. Still further, it would be advantageous if such vacuum cleaners did not require the use of a disposable bag to retain dirt and debris, insofar as such bags are often messy and require a user to frequently replace such bags (creating additional costs associated with the vacuum). Furthermore, it would be advantageous to provide a vacuum cleaner that exhibits improved power management, suction forces, and efficiency over prior art vacuums.

As the following will demonstrate, the present invention addresses many of these needs in the marketplace, as well as others.

SUMMARY OF THE INVENTION

According to certain aspects of the invention, a canister vacuum cleaner is provided, which includes a substantially cylindrical exterior casing that has a top half and a bottom half. The interior area of the bottom half of the casing is configured to house a motor, which is adapted to generate a suction force that is ultimately transmitted through a tube and out an appended hose. The invention provides that the hose is reversibly connected to the casing through an air inlet portal. The invention provides that by positioning the motor within the bottom half of the casing and, preferably, at the bottom-most portion of the casing, the vacuum cleaner exhibits a more preferred and ergonomic center of gravity, which renders the vacuum cleaner easier (and, for frequent users, safer) to wear, as described below.

The vacuum cleaner further includes a backpack accessory (support) that is affixed to the exterior casing, which enables a person to wear the vacuum cleaner in a manner that positions the vacuum cleaner adjacent to the person's back (with the heavier motor being positioned near the person's waist). This configuration—with the heavier motor being positioned near a person's waist (when the vacuum is worn)—has been shown to be particularly beneficial for women users of the vacuum (as described further below). The invention provides that a receiving plate is preferably affixed to the exterior casing, with the receiving plate being configured to reversibly receive and be connected to the backpack accessory. The invention provides that the backpack accessory will preferably include two padded shoulder straps, a padded waist strap, and a cushioning pad or surface that is disposed between a person's back and the casing (when the vacuum cleaner is being worn by the person). In addition, the topside of the backpack accessory may optionally include a loop that may be used to hang the backpack accessory, e.g., on a hook or other element, and, optionally, the canister vacuum cleaner when it is affixed to the backpack accessory.

Importantly, the invention provides that the canister vacuum cleaner will not require the use of a disposable bag to capture and retain dirt and debris that the vacuum cleaner extracts from the external environment. In certain preferred embodiments, as described further below, the vacuum cleaner is configured to employ a form of cyclonic separation of air and dirt within an interior area of the casing. In such embodiments, for example, the interior area of the casing will include a least one internal cylinder that is configured to employ a form of cyclonic separation of dirt and debris from air.

More specifically, the invention provides that the motor will be positioned and configured to generate a suction force, which is transmitted through a tube located between the receiving plate and the external surface of the casing, and then into the interior of the vacuum cleaner (through the top portion thereof). The suction force passes over an internal cylinder, out an air inlet portal, and through an appended hose. As such, when this suction force retrieves dirt/debris from the environment, the dirt/debris travel through the hose and into the vacuum through the air inlet portal, whereupon the air/dirt/debris mixture enters the interior of the vacuum cleaner at an angle that causes the heavier dirt/debris to be forced (by a centrifugal force) into the internal wall of the cylinder, such that the heavier dirt/debris subsequently falls into a collection reservoir (through a gravity force). The lighter dirt/debris are collected through a filter, e.g., a HEPA filter, located near the top of the vacuum, as described further below.

The invention provides that the exterior casing will preferably include at least two portions that may be reversibly connected to each other to form the substantially cylindrical exterior casing. The invention provides that the two portions of the exterior casing may be reversibly disconnected to reveal an interior area of the casing, such that collected dirt and debris may be removed from a dedicated area of the vacuum cleaner, e.g., from one or more reservoirs where dirt and debris are collected and retained. In certain preferred embodiments, however, the vacuum cleaner may be separated into three constituent parts, e.g., the motor portion (at the bottom), a middle portion where dirt/debris are allowed to collect, and a top portion (which contains a HEPA filter).

As mentioned above, the invention provides that the canister vacuum of the present invention may further employ the use of one or more filters within the interior area of the casing, which are configured to help separate dirt/debris from air that is received by the canister vacuum. For example, the air inlet portal mentioned above (which is configured to receive and be reversibly connected to an exterior flexible hose) may be located within the top half of the casing (or near a middle portion of the casing), and have an interior side that is positioned adjacent to a filter. The filter may be configured to capture and prevent certain debris, which are suctioned through the hose, from entering the other internal parts of the vacuum cleaner.

As described and shown herein, the canister vacuum cleaner will include an air inlet portal located within the top half (or near the middle portion) of the exterior casing and an air vent located within the bottom half of the exterior casing. The invention provides that the air vent is preferably located adjacent to the motor, and will be configured to allow air to escape (i.e., the air that is suctioned through the vacuum cleaner as described herein). In addition, the air vent will further be configured to dissipate heat that is generated by the motor. In certain embodiments, the canister vacuum cleaner may further be configured with a handle located at the topside of the exterior casing. The handle may be used to transport the vacuum cleaner when not in use or, alternatively, during use when a person does not wish to wear the vacuum cleaner using the backpack accessory.

According to still further aspects of the invention, the canister vacuum cleaner may exhibit improved power management and efficiency features. More specifically, the invention provides that, in certain embodiments, the vacuum cleaner may be configured to avoid having air (suction) travel through external tubes located on the outside of the bagless dirt chamber that are common in prior art vacuums. Instead, the air (suction) will be directed to travel through a large tube located within the interior of the vacuum dirt chamber, such that the air will then travel directly back to the motor. Such configuration eliminates the need for external tubing, which otherwise decreases air flow and power efficiency. The invention provides that the increase in power management and efficiency that is gained by such configuration allows a relatively smaller motor to be employed (which further renders the vacuum more ergonomic), without significantly compromising suction power. In some embodiments, the vacuum may be powered by an internal DC battery.

According to yet further related aspects of this invention, vacuum cleaners are provided that are configured to provide three separate means of cyclonic separation, before dirt and debris are allowed to pass through a filter. In such embodiments, the third means of cyclonic separation employs centrifugal force (instead of gravity) to separate fine dust and dirt particles from air, before the air passes through a filter. That is, certain prior art bagless vacuum cleaners employ a first and secondary means for collecting dirt and debris from air, and rely on gravity forces to remove most of the remaining dust and dirt particles before the air is allowed to pass through a filter. However, relatively fine (small) dust and dirt particles are often less affected by gravity forces within a bagless vacuum cleaner (due to the suction of the vacuum overcoming the pull that gravity force has on small particles). For this reason, the smallest particles found in prior art bagless vacuums typically pass through the first and secondary means of collection, and are thereafter captured by a filter. As a result, prior art bagless vacuum cleaners become less efficient over time, as dust and dirt particles begin to clog the filter and reduce suction.

As explained further below, the vacuum cleaners of such embodiments generally include an exterior casing that has a top half and a bottom half, with an interior area of the bottom half of the casing housing a motor that is configured to generate a suction force. In addition, the vacuum cleaners include an interior tube within the casing, which is fluidly coupled to the motor. The invention provides that the interior tube is configured to funnel air generated by the motor to and from a top interior portion of the casing. In addition, similar to the other embodiments described above, the vacuum cleaners include an internal cylinder disposed within the interior tube, with the internal cylinder being smaller in diameter compared to the interior tube. The invention provides that the internal cylinder is configured to funnel air that exits the interior tube back to the motor.

As mentioned above, the invention provides that the third means of cyclonic separation employs centrifugal force (instead of gravity) to separate fine dust and dirt particles from air, before the air passes through a filter. To accomplish such functionality, the vacuum cleaner further includes one or more vents located at the top interior portion of the casing, which are configured to receive air from the interior tube and funnel the air into a circular motion around a top portion of the internal cylinder, thereby creating a centrifugal force that pushes fine dust and dirt particles to the outside (interior walls of the casing), while allowing the air to pass through one or more filters on the inside of the vacuum (near the internal cylinder). In such embodiments, the vacuum cleaners include a filter disposed between the one or more vents and the internal cylinder, with the filter being positioned such that air must pass through the filter when exiting the one or more vents and before entering the internal cylinder. As such, instead of using gravity to separate finer dust and dirt particles, the vacuum of the present invention uses a third cyclonic separation step (to suspend dust and dirt particles near the interior walls of the casing, to keep such particles away from the filter). When the vacuum is powered off, the suspended particles fall down into the lower chamber (area) of the vacuum. The vacuums of such embodiments are more efficient and powerful.

The above-mentioned and additional features of the present invention are further illustrated in the Detailed Description contained herein.

DETAILED DESCRIPTION OF THE INVENTION

Figure 1:
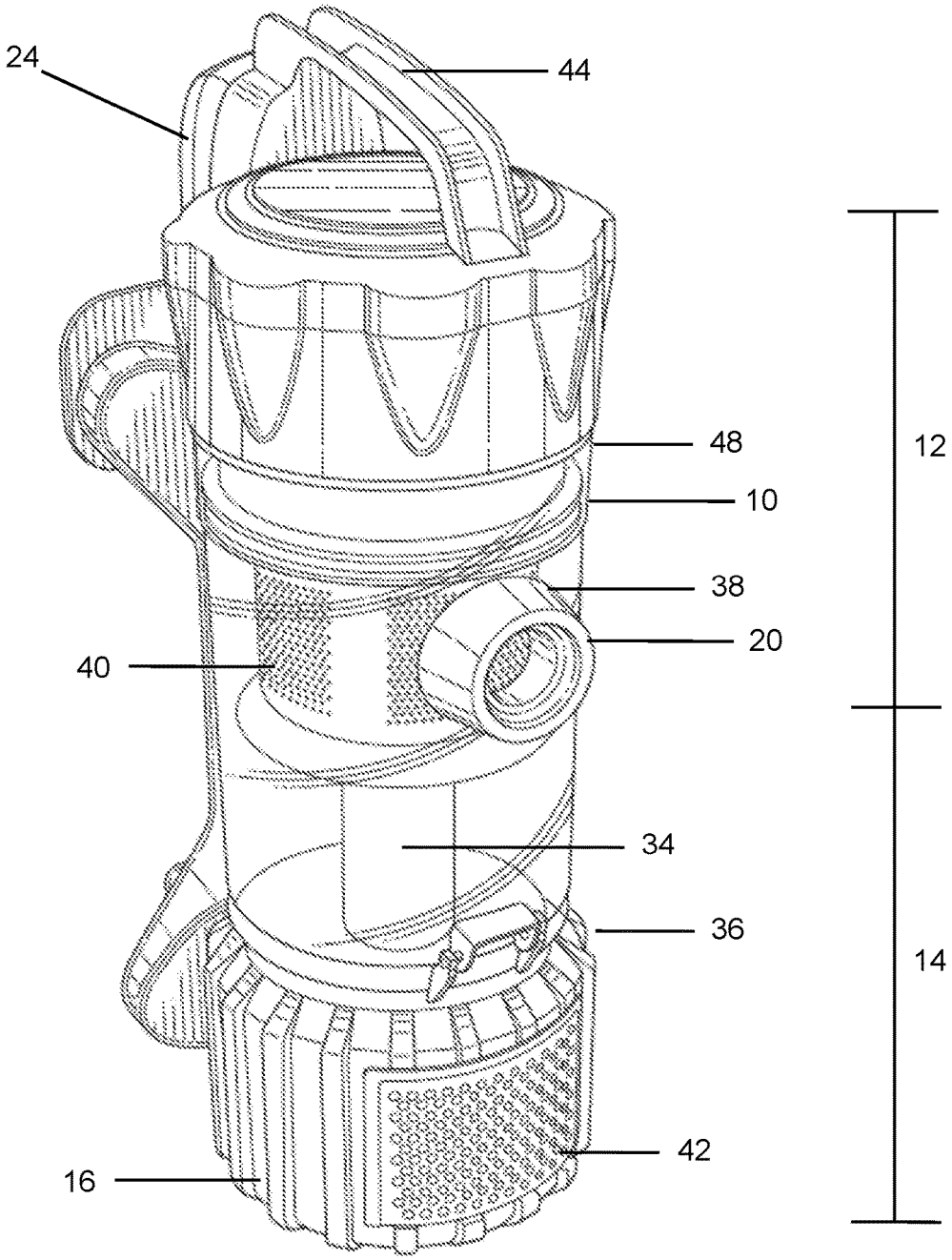
FIG. 1 is a perspective view of the vacuum cleaner described herein.
Figure 2:
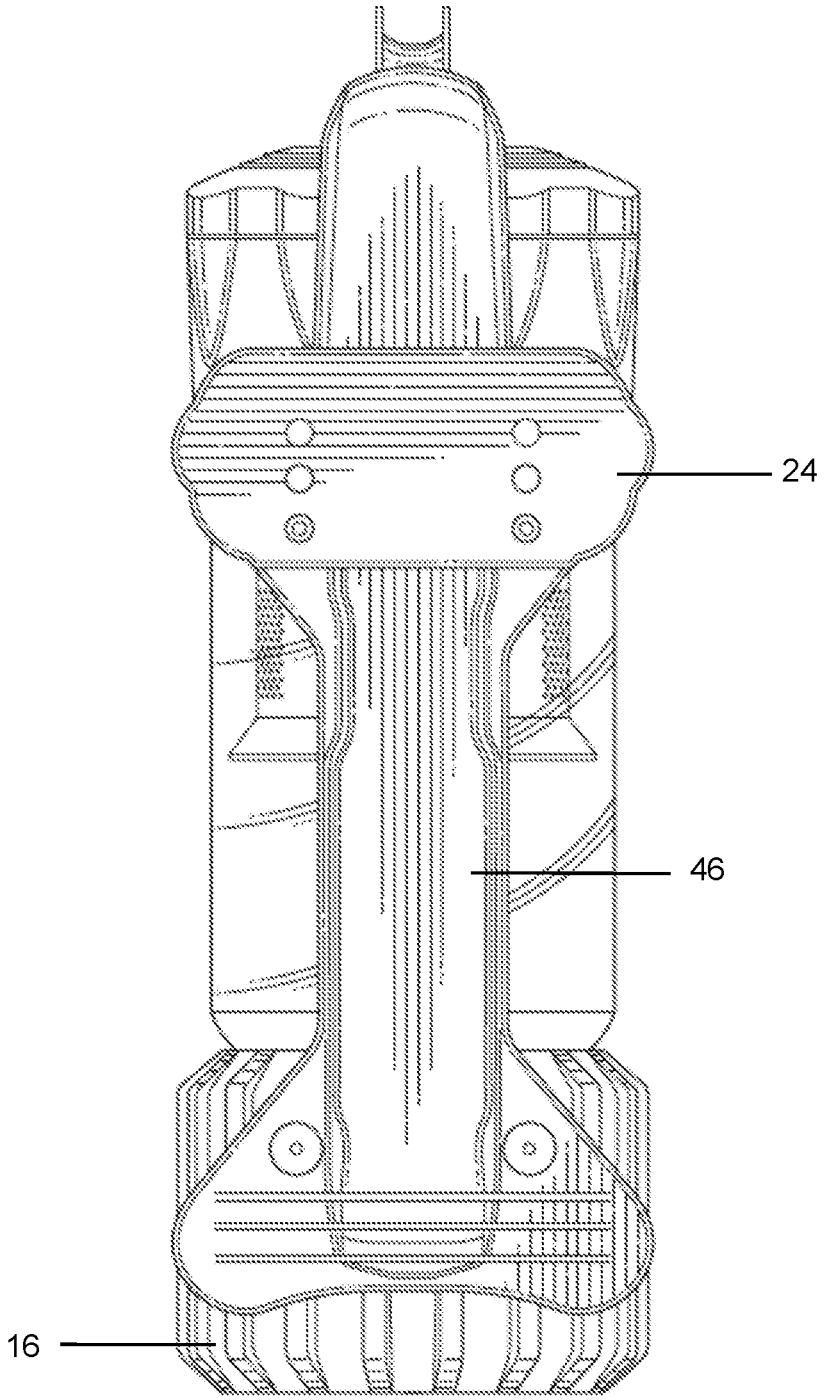
FIG. 2 is a backside view of the vacuum cleaner described herein.
Figure 3:
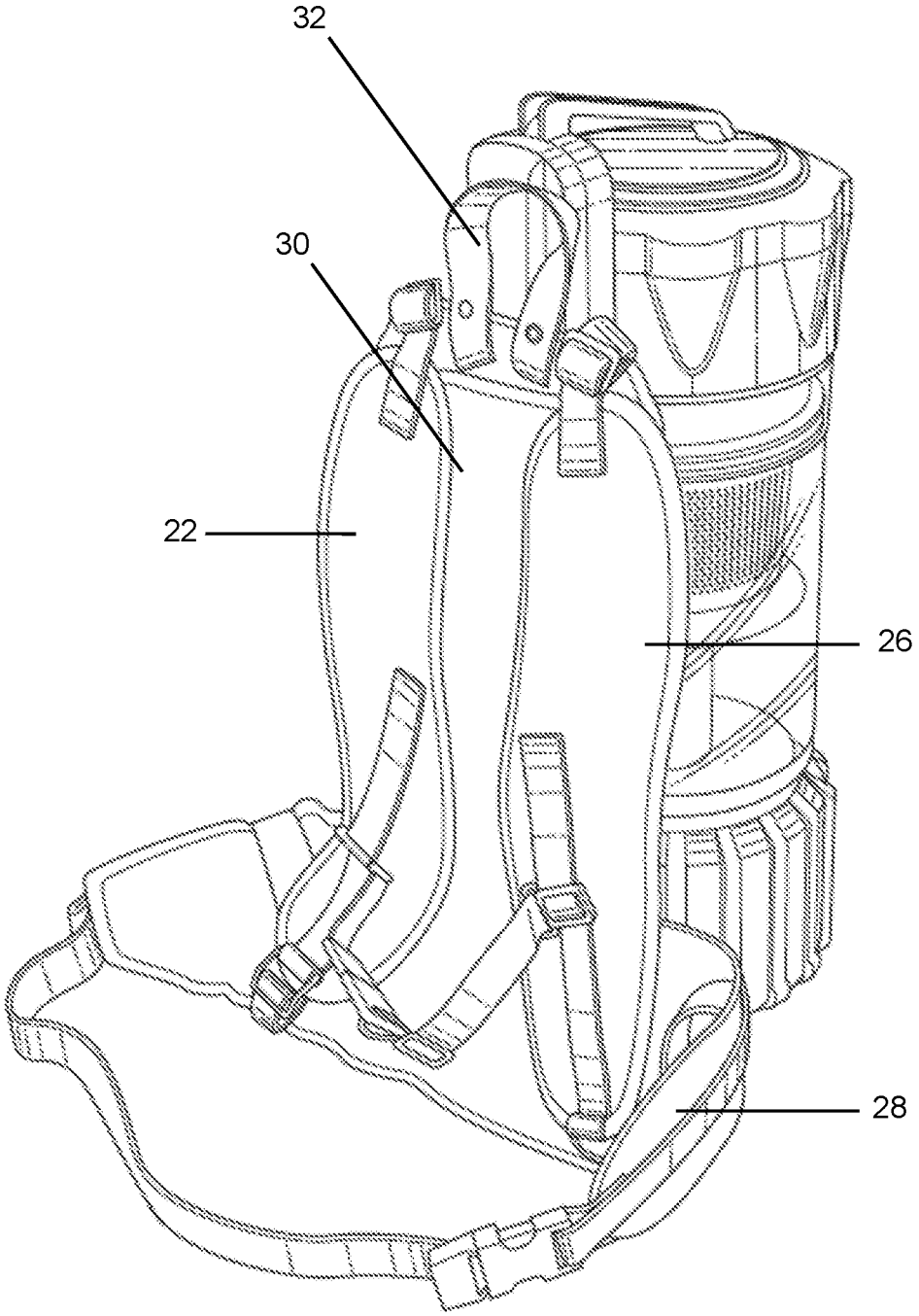
FIG. 3 is another perspective view of the vacuum cleaner described herein, which further shows the backpack carrying accessory described herein.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

According to certain preferred embodiments of the invention, a canister vacuum cleaner is provided that exhibits a number of desirable qualities. Specifically, the canister vacuum exhibits an ergonomically preferred and user-enhanced center of gravity. In addition, the canister vacuum is highly portable and user-friendly, since the vacuum may be worn using a backpack accessory and, furthermore, does not require the use (nor the cost) of disposable bags to collect and retain the dirt and debris that are harvested from suctioned air. In addition, due to the placement of the heavier motor (being near a person's waist), the vacuum cleaner has been found to be particularly suitable and easier to use for women.

Referring now to FIGS. 1-7, according to certain preferred embodiments of the present invention, the vacuum cleaner comprises a cylindrical (or substantially cylindrical) and hollow exterior casing 10. The casing 10 will comprise a top half 12 and a bottom half 14. The hollow interior of the casing 10 is configured to hold certain working parts of the vacuum, which are described further below.

The interior area of the bottom half 14 of the casing houses a motor 16 that is configured to generate a suction force. More specifically, and in certain preferred embodiments, the motor 16 is located at the bottom-most portion of the casing 10. The suction (vacuum) force that is generated by the motor 16 is transmitted through a tube 46 (FIG. 2) that is positioned between the exterior of the casing 10 and the receiving plate 24 described below. This suction force then reenters the casing 10 near the top of the vacuum cleaner (near a handle 44). The suction force passes through a flexible hose and enters an internal cylinder 34 through an internal tube and into the motor 16 (as discussed further below), and then exits the casing 10 through an air portal 20.

The invention provides that by positioning the motor 16 within the bottom half 14 of the casing (and, preferably, at the bottom-most portion of the casing 10), with the motor 16 being among the heaviest components of the vacuum, the vacuum cleaner exhibits a more preferred and ergonomic center of gravity. This improved center of gravity—which will be located near a person's waist—will render the vacuum cleaner easier to use (particularly for women users). In addition, for those who frequently operate the vacuum cleaner (e.g., professional cleaners), the improved center of gravity will reduce user fatigue and the potential for injury or muscle strain.

The vacuum cleaner further includes a backpack accessory 22 (FIG. 3) that is affixed to the exterior casing 10, which enables a person to wear the vacuum cleaner in a manner that positions the vacuum cleaner adjacent to the person's back. More particularly, the invention provides that a receiving plate 24 (FIG. 2) is preferably affixed to the exterior casing 10, with the receiving plate 24 being configured to reversibly receive and be connected to the backpack accessory 22. The receiving plate 24 may be attached to the backpack accessory 22 through a variety of mechanical means, such as snaps, latches, buckles, or other means. The invention further provides that the receiving plate 24 may be comprised of a vibration damping material, such as certain vibration damping elastomers, which will be effective to reduce the amount of vibration that is transmitted by the vacuum cleaner (during operation) to a person's back.

The invention provides that the backpack accessory 22 will preferably include two padded shoulder straps 26, a padded waist strap 28, and a cushioning pad 30 that is disposed between a person's back and the casing 10 (when the vacuum cleaner is being worn by the person). The padded shoulder straps 26 and padded waist strap 28 are preferably adjustable, and may be opened and closed through corresponding buckles. In addition, the topside of the backpack accessory 22 may optionally include a loop 32 that may be used to hang the backpack accessory 22, e.g., on a hook or other element (and, optionally, the canister vacuum cleaner when it is affixed to the backpack accessory 22).

Importantly, the invention provides that the canister vacuum cleaner will not require the use of a disposable bag to capture and retain dirt and debris that the vacuum cleaner extracts from an external surface or other areas of the environment. That is, the vacuum cleaner will be "bagless," which avoids the need to periodically replace the bag (and the costs associated therewith). In certain preferred embodiments, the invention provides that the vacuum cleaner is configured to employ a form of cyclonic separation of air and dirt within an interior area of the casing. In such embodiments, the interior area of the casing will include a least one internal cylinder 34 that is configured to employ a form of cyclonic separation of dirt and debris from air.

More specifically, the invention provides that the motor 16 will be positioned and configured to generate a suction force, which is transmitted through a tube 46 located between the receiving plate 24 and the external surface of the casing 10, and then into the interior of the vacuum cleaner (through the top portion thereof). The suction force passes over the internal cylinder 34, out the air portal 20, and through an appended hose. Accordingly, when this suction force retrieves dirt/debris from the environment, the dirt/debris travels through the hose and into the vacuum through the air portal 20, whereupon the air/dirt/debris mixture enters the interior of the vacuum cleaner at an angle that causes the heavier dirt/debris to be forced (by a centrifugal force) into the internal wall of the cylinder 34, such that the heavier dirt/debris subsequently falls into a collection reservoir (through a gravity force). The lighter dirt/debris are collected through one or more filters, e.g., a HEPA filter, located near the top of the vacuum. The cleaned air—after passing through the one or more filters—travels through the tube 46, through the motor 16, and out an air vent 42 (described below).

The invention provides that the exterior casing 10 will preferably include at least two portions that may be reversibly connected to each other to form the substantially cylindrical exterior casing 10. For example, the invention provides that a first portion may receive and be reversibly connected to a second portion, e.g., through a mechanical attachment means, such as correspondingly threaded surfaces, snaps, latches, or other means. The invention provides that the two portions of the exterior casing 10 may be reversibly disconnected to reveal an interior area of the casing 10, such that collected dirt and debris may be removed from a dedicated area of the vacuum cleaner, e.g., from one or more reservoirs where dirt and debris are collected and retained. More specifically, for example, the invention provides that a portion of the casing 10 that holds the motor 16 may be removed from the remaining portion of the casing 10, e.g., with the portion of the casing that holds the motor 16 having a threaded surface that is configured to receive and be connected to a correspondingly threaded surface of the remaining portion of the casing (at or near an interface 36 between such portions). By unscrewing and disconnecting those portions of the casing 10, the dirt and debris that have been collected and retained within the casing 10, vis-à-vis the cyclonic separation means of the internal cylinder 34 described above, may be periodically removed.

In still further embodiments, the vacuum cleaner of the subject invention may include three constituent parts that may be reversibly connected to each other, such as the portion of the casing that holds the motor 16, a middle portion that holds collected dirt/debris, and a top portion that houses the one or more filters. In this embodiment, the vacuum cleaner may be disassembled at the interfaces of the three constituent parts, namely, interface 36 and 48. The invention provides that these parts may be held together through a mechanical latch mechanism, which may be released using one or more buttons.

Although the cyclonic separation means of the internal cylinder 34 will provide a reliable and effective way to separate dirt/debris from the ingested air, particularly heavier dirt/debris, the invention provides that the canister vacuum of the present invention may further employ the use of one or more filters within the interior area of the casing 10 (as mentioned above), such as high-efficiency particulate air (HEPA) filters. Such filters will be configured to further help separate lighter dirt/debris from air that is received by the canister vacuum. For example, the air portal 20 mentioned above (which is configured to receive and be reversibly connected to an exterior flexible hose) may be located within the top half 12 of the casing, and have an interior side 38 that is positioned adjacent to or in proximity of a filter 40. The filter 40 will preferably be configured to help capture dirt/debris that are suctioned through the hose.

As shown herein and described above, the canister vacuum cleaner will include an air portal 20 located within the top half 12 of the exterior casing 10 (or near the middle of the casing 10, between the top half 12 and bottom half 14) and an air vent 42 located within the bottom half 14 of the exterior casing 10. The invention provides that the air vent 42 is preferably located adjacent to the motor 16. The air vent 42 will be configured to allow cleaned air to escape the vacuum cleaner, i.e., the air that is suctioned through the hose, air portal 20, and tube 46 will exit the vacuum cleaner through the air vent 42. In addition, the invention provides that the air vent 42 will further be configured to dissipate heat that is generated by the motor 16. Accordingly, the air vent 42 may be comprised of a material with a lower heat conductivity (retention) property, such that the air vent 42 does not become extremely hot during operation of the vacuum cleaner.

In certain embodiments of the present invention, the canister vacuum cleaner may be configured with a handle 44 located at the topside of the exterior casing 10, with the handle 44 preferably being integrally formed with (or attached to) the receiving plate 24. The handle 44 may be used to transport the vacuum cleaner when not in use or, alternatively, during use when a person does not wish to wear the vacuum cleaner using the backpack accessory 22 described above.

Referring now to FIGS. 4-7, according to further embodiments of the present invention, the canister vacuum cleaner may exhibit certain improved power management and efficiency features. More specifically, the invention provides that, in certain embodiments, the vacuum cleaner may be configured to avoid having air (suction) travel through the external tube 46 (FIG. 2) located between the receiving plate 24 and the external surface of the casing 10 and then back into the interior of the vacuum cleaner through the top portion thereof as described above (and/or through other external, twisting tubes that are common in prior art vacuums).

Figure 4:
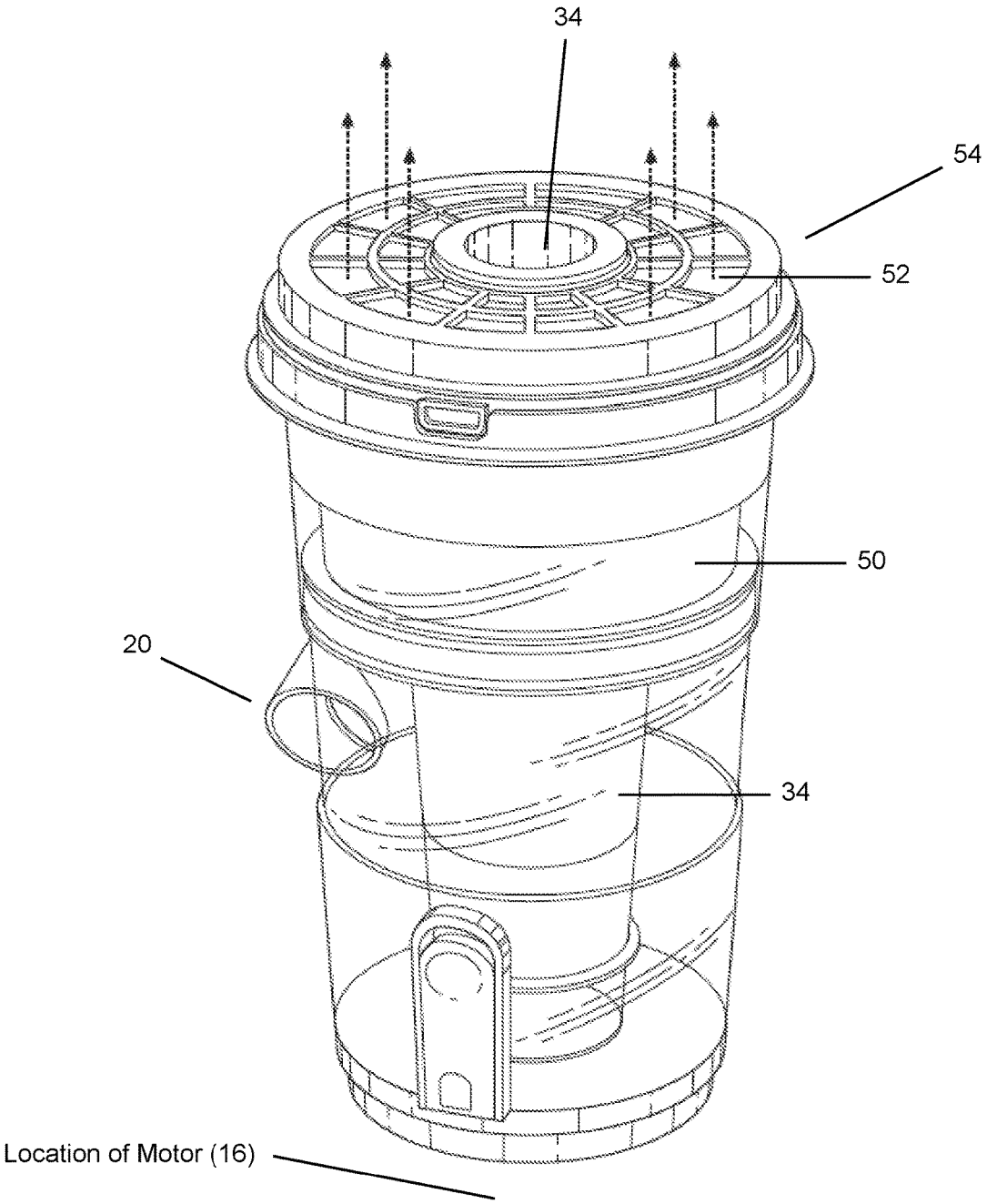
FIG. 4 is a view of an alternative embodiment of the vacuum cleaner described herein, which includes a large tube through which air travels within the interior of the vacuum before returning to the motor.
Figure 5:
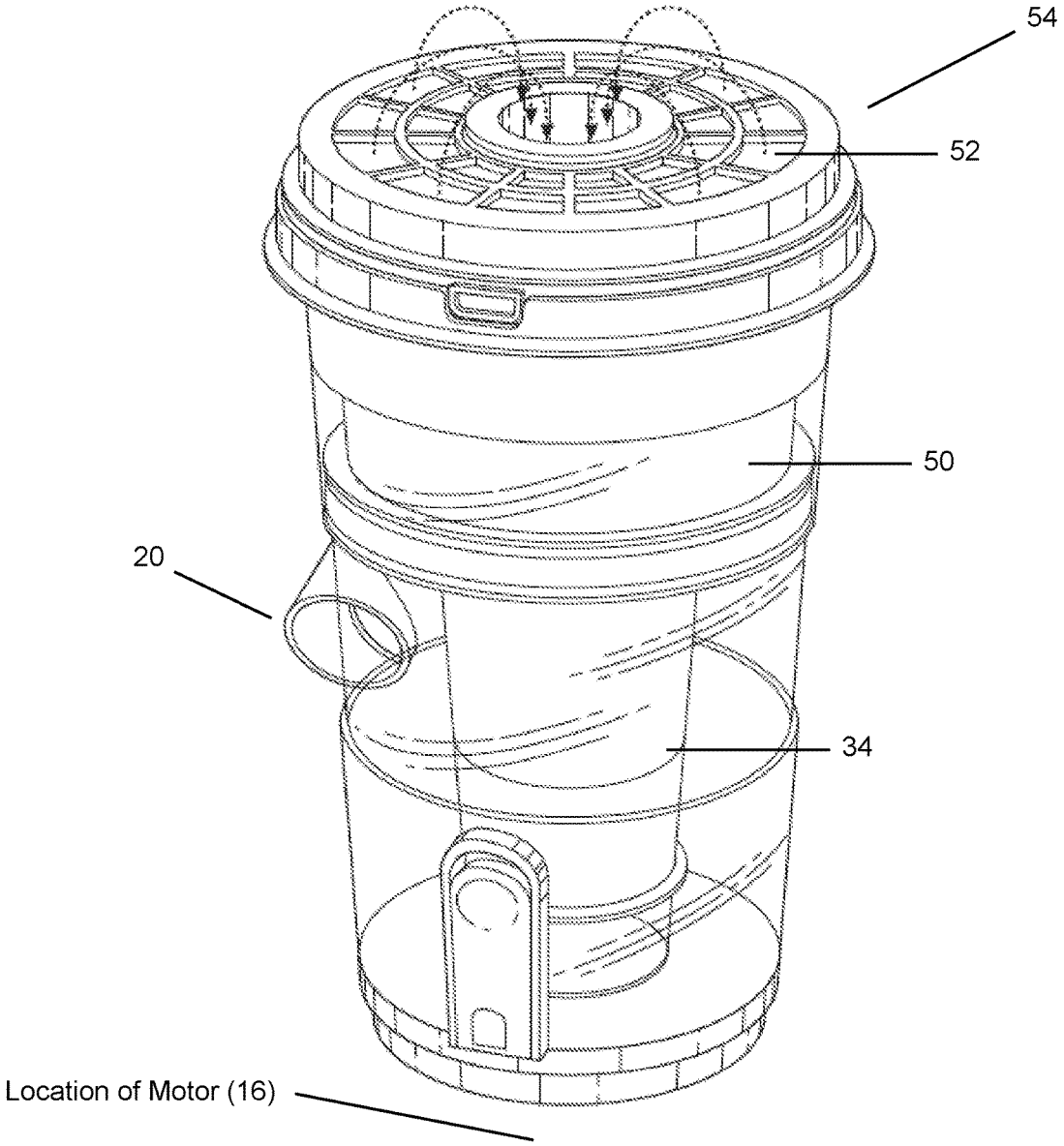
FIG. 5 is another view of the vacuum cleaner of FIG. 4, showing the direction of air travelling back to the motor after it leaves the large internal tube.
Figure 6:
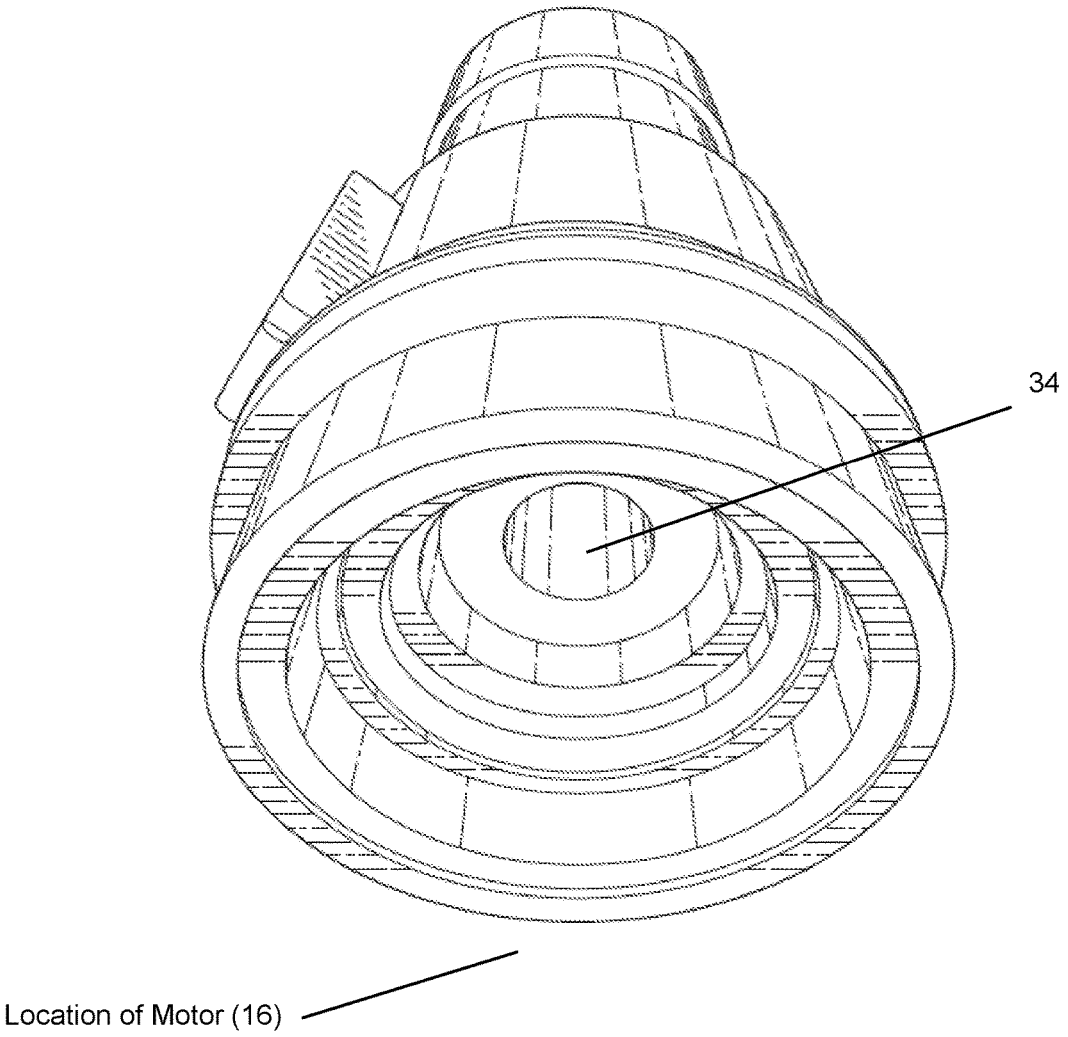
FIG. 6 is a bottom view of the vacuum cleaner of FIG. 4 (with the motor removed).
Figure 7:
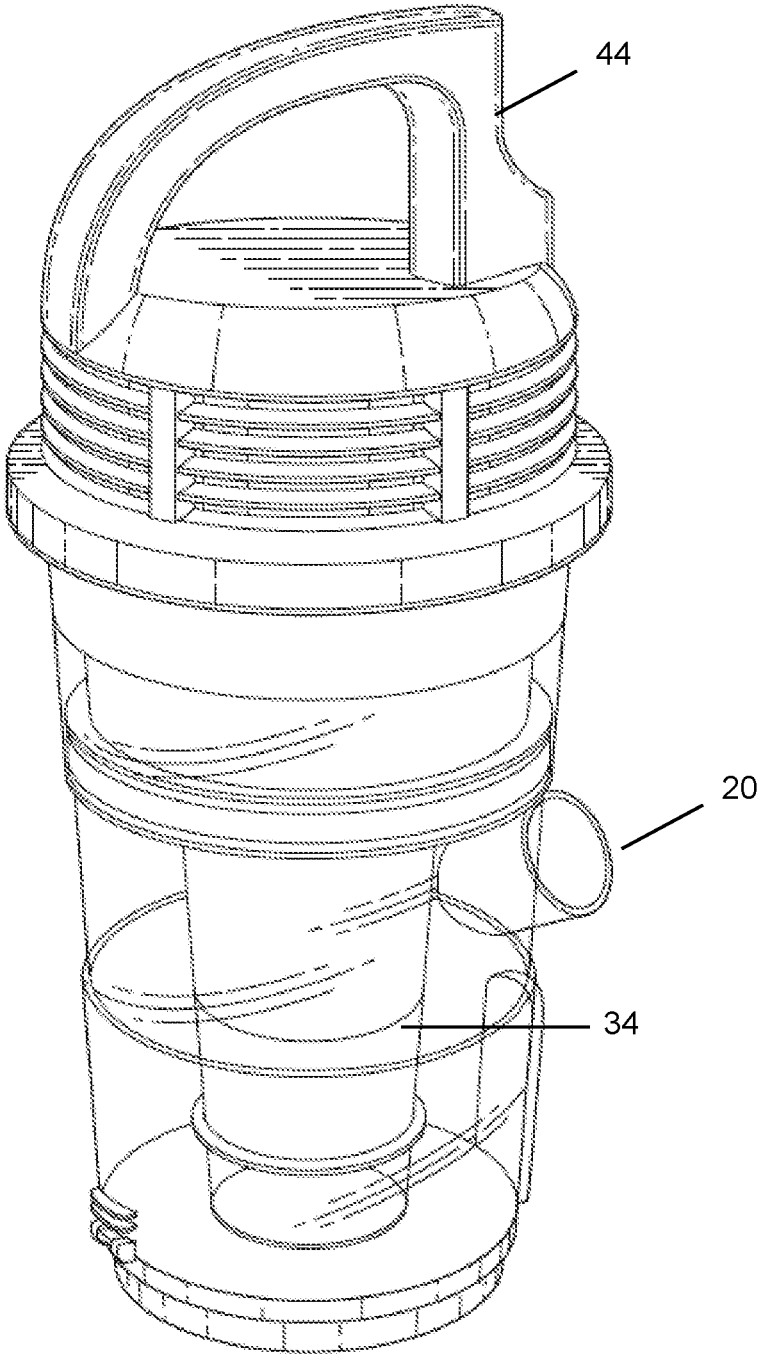
FIG. 7 is another view of the vacuum cleaner of FIG. 4, showing the handle/top portion being applied thereto.
Figure 8:
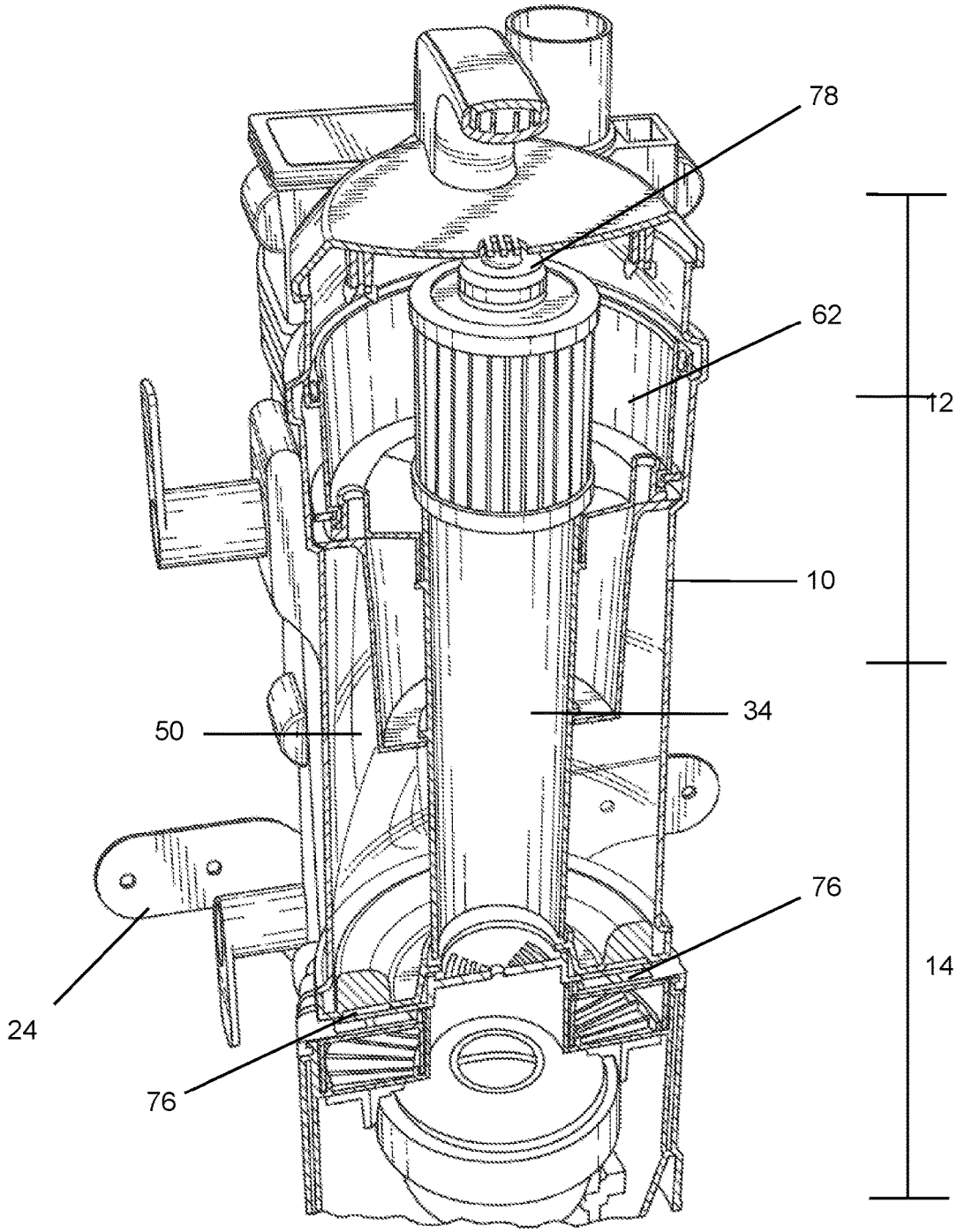
FIG. 8 is a cross-sectional view of another embodiment of the vacuum cleaners described herein, which are configured to provide a first, second, and third cyclonic separation function.

Instead, the invention provides that the air (suction) that is generated by the motor 16 will be directed to travel through a large tube 50 located within the interior of the vacuum (with the large interior tube 50 being fluidly coupled to the motor 16), such that the air will travel back to the motor 16 (not shown in FIGS. 4-7) through the internal cylinder 34 described above (See FIGS. 4 and 5). The motor 16 will be located within the bottom half of the casing 10 (as described above), and more preferably at a bottom-most location of the exterior casing 10 as shown and described in relation to FIGS. 1-3. The invention provides that before returning to the motor 16 through the internal cylinder 34, the air will be forced to exit the larger interior tube 50 at the top interior portion 54 of the casing 10 and travel through a filter or series of filters 52 (FIG. 4). The invention provides that the filter(s) 52 will be configured to remove lighter dirt/debris that are contained within the air, before the air travels through the internal cylinder 34 back to the motor 16 and out an air vent 42 (as described above). In these embodiments, the interior (large) tube 50 will exhibit a greater diameter than the internal cylinder 34, with the internal cylinder 34 being disposed within—and preferably in the middle of—the interior (large) tube 50.

The invention provides that the vacuum configuration of FIGS. 4-7 eliminates the need for the external tube 46 (FIG. 2) described above, as well as other external (and often twisted and long) tubing that is common among prior art vacuums. Such external tubing will often decrease air flow and power efficiency. The invention provides that the increase in power management and efficiency that is gained by the vacuum configuration of FIGS. 4-7 allows a relatively smaller motor to be employed, i.e., a motor that is smaller in size and power relative to the motors that are typically found in prior art vacuums. This translates into improved ergonomics for the vacuum, without significantly compromising suction power.

Still further, the invention provides that the increase in power management and efficiency that is gained by the vacuum configuration of FIGS. 4-7 allows the vacuum (and the motor 16) to be powered by an internal DC battery. Accordingly, in certain embodiments, the canister vacuum cleaner of the present invention may comprise an internal DC battery supply, which is operably and electrically connected to the motor 16. Preferably, the internal DC battery will be rechargeable, and will include a port through which energy may be provided to the internal DC battery by a conventional wall outlet.

Figure 9:
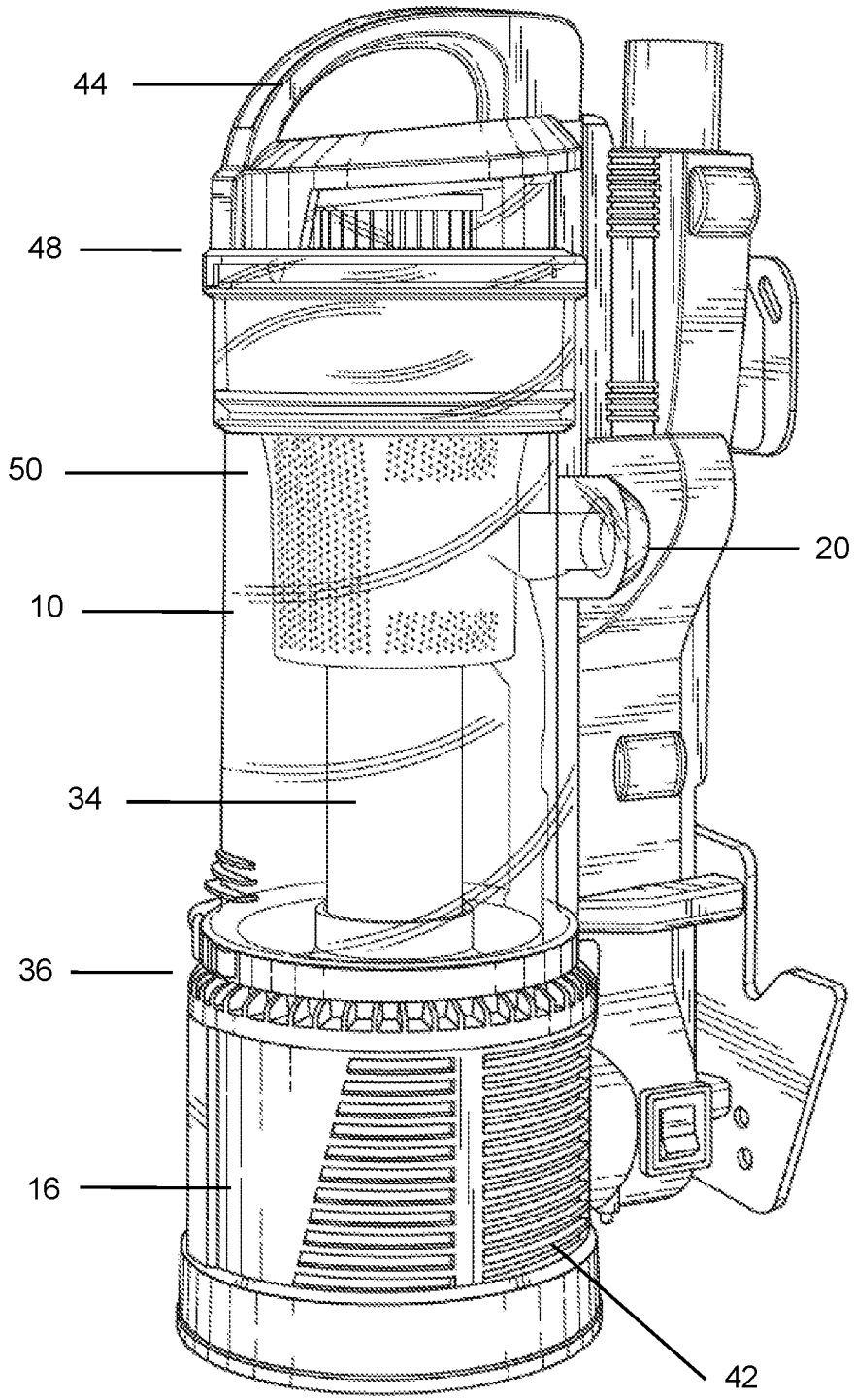
FIG. 9 is an exterior side view of the vacuum cleaner of FIG. 8.
Figure 10:
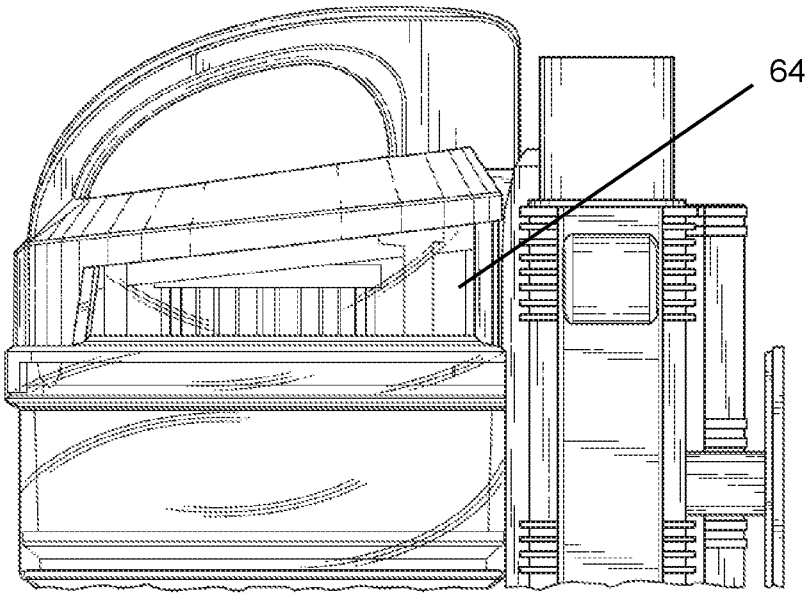
FIG. 10 is an exterior side view of the top portion of the vacuum cleaner of FIG. 8, showing the location of the filter window described herein.

Referring now to FIGS. 8-12, according to yet further embodiments of the present invention, a vacuum cleaner is provided that is configured to provide a first, second, and third means of cyclonic separation function. In such embodiments, the third means of cyclonic separation employs centrifugal force (instead of gravity) to separate fine dust and dirt particles from air, before the air passes through a filter. More particularly, such embodiments are similar to those of FIGS. 4-7, insofar as the invention provides that the air (suction) that is generated by the motor 16 will be directed to travel through a large tube 50 located within the interior of the vacuum (with the large interior tube 50 being fluidly coupled to the motor 16), such that the air will eventually travel back to the motor 16 through an internal cylinder 34. As in the other embodiments described herein, the motor 16 will preferably be located within the bottom half of the casing 10 (as described above), and more preferably at a bottom-most location of the exterior casing 10, as shown in FIG. 9. The air (suction) that is generated by the motor 16, and travels through the large tube 50, will generate a suction force that is transmitted through the air portal 20 (and a flexible hose that may be reversibly connected to the casing 10 through the air portal 20). The invention provides that the cylindrically-shaped casing 10 and large interior tube 50 will cause the air (suction) that is generated by the motor 16 to rotate and create a cyclonic separation (whereby dirt and debris that enter the vacuum through the air portal 20 are forced (via centrifugal force) into the interior side of the casing 10 and separated from air that later travels to the internal cylinder 34).

In addition, according to certain preferred embodiments, before the air travels back to the motor 16 through the internal cylinder 34, additional debris will be removed from the air by one or more filters, such as one or more HEPA filters. The invention provides that the one or more filters will be positioned in a location 62 outside the perimeter of the internal cylinder 34, near the top area of the internal cylinder 34. The invention provides that the casing 10 may include a clear window 64 (FIG. 10) through which the one or more filters may be viewed. The invention provides that the clear window 64 allows the current condition of the one or more filters to be visually assessed, without the need for disassembling the vacuum components.

Figure 11:
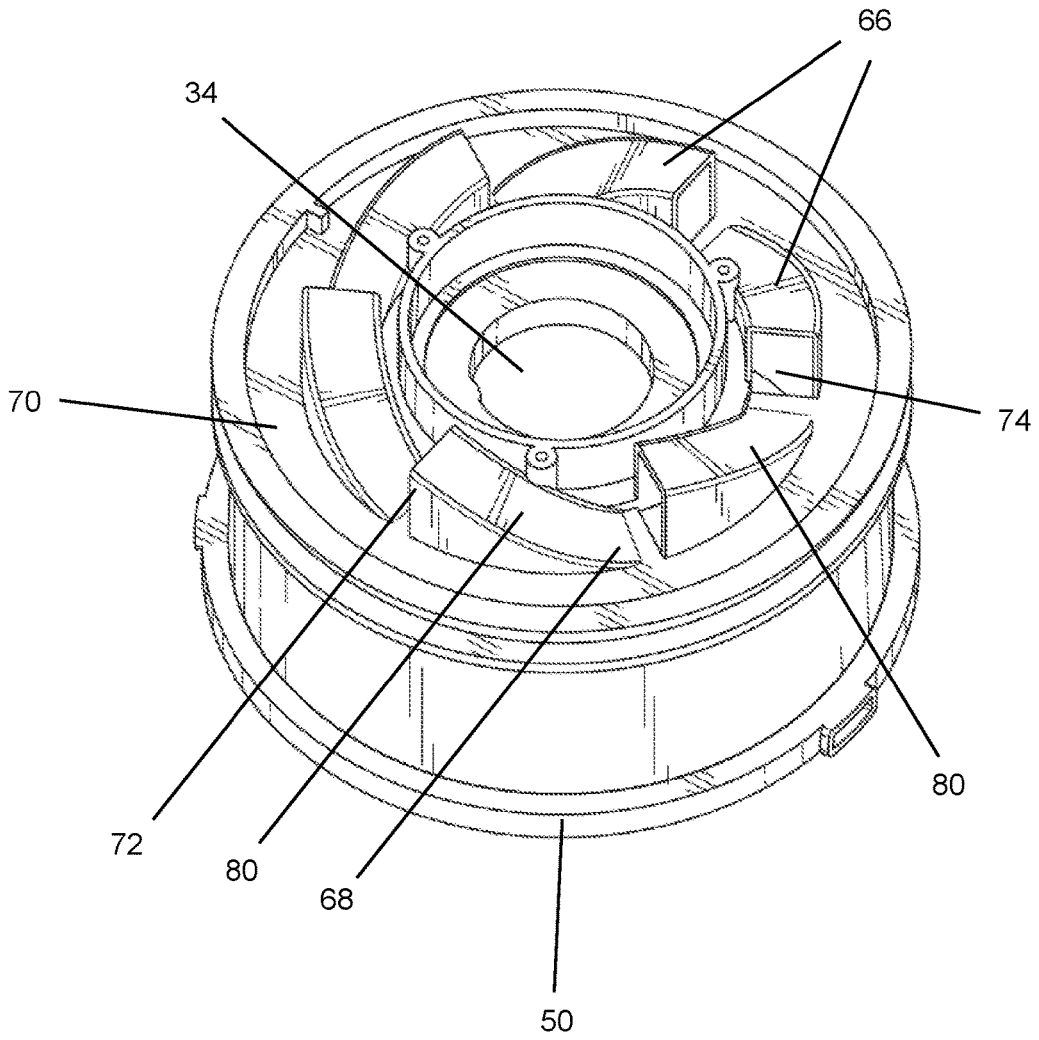
FIG. 11 is a top perspective view of the series of vents described herein, which enables the second cyclonic separation function in the vacuum cleaner of FIG. 8.
Figure 12:
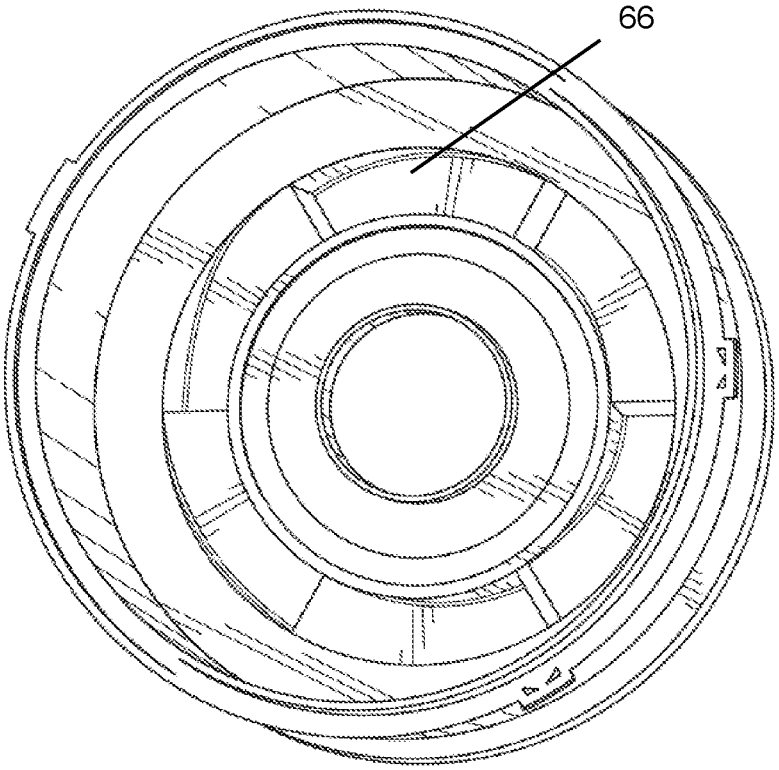
FIG. 12 is a bottom perspective view of the series of vents of FIG. 11.

Referring now to FIGS. 11 and 12, according to such embodiments, the vacuum cleaner further includes a series of vents 66, which are fluidly coupled to a top portion of the large tube 50 located within the interior of the vacuum cleaner. The invention provides that the air (suction) that is generated by the motor 16 will be directed to travel through the large tube 50 located within the interior of the vacuum, which then exits the large tube 50 through the series of vents 66 located at the top of the large tube 50. The series of vents 66 are configured and oriented to funnel the air into a circular motion around the internal cylinder 34, thereby creating a centrifugal force that pushes fine dust and dirt particles to the outside (into the interior walls of the casing 10), while allowing the air to pass through one or more filters on the inside of the vacuum (near the internal cylinder 34). For example, each of the series of vents 66, e.g., six vents 66 positioned around the perimeter of the centrally-located internal cylinder 34, may exhibit a substantially triangular cross-section, with a first end 68 of each vent 66 being adjacent to a floor surface 70 that extends around the internal cylinder 34 (with the floor surface 70 positioned perpendicular to the central axis of the internal cylinder 34), and a second end 72 of each vent 66 comprising an aperture 74 through which air is funneled. As illustrated in FIG. 11, the invention provides that air exiting the aperture 74 of each vent 66 is funneled over a top surface 80 of a neighboring vent 66, with the top surface 80 having a gradual slope that minimizes air flow interference (which thereby enhances the rotational motion of the air).

The invention provides that the aperture 74 of each vent 66 will be pointed in the same direction around the internal cylinder 34, e.g., in a clockwise or counter-clockwise orientation, such that when air exits the vents 66 the air will exhibit a circular (centrifugal) motion around the internal cylinder 34. The invention further provides that such (centrifugal) motion around the internal cylinder 34 creates another cyclonic separation function, such that additional dust and debris are removed and retained within the large interior tube 50, before the air travels through the one or more filters that are positioned in a location 62 outside the perimeter of the internal cylinder 34, near the top area of the internal cylinder 34. This additional cyclonic separation function forces dirt and debris into the interior side of the casing 10 (as described above), such that after the vacuum is deactivated (powered off), the dirt and debris fall to the floor of the large interior tube 50 (such that the dirt and debris may later be removed from the vacuum). This additional cyclonic separation has been found to render the filters at least 50% more efficient, to increase the longevity of such filters, and to dramatically enhance the suction power of a vacuum.

The invention provides that after the air travels through the one or more filters that are positioned in a location 62 outside the perimeter of the internal cylinder 34, near the top area of the internal cylinder 34, the cleaned air is then forced into the internal cylinder 34, which is then allowed to exit through an exhaust valve 76 (FIG. 8), which may comprise its own exhaust filter (e.g., a HEPA or foam filter). In certain embodiments, the top portion of the internal cylinder 34 may comprise a one-way valve 78 (FIG. 8) through which the cleaned air may travel. In such embodiments, the one-way valve 78 is configured to prevent unwanted backflow of air or pressure from the internal cylinder 34.

In addition to the canister vacuums and portable vacuums described herein, the invention provides that the components described herein—and particularly those which create the first, second, and third cyclonic separation functions—may also be used and incorporated into upright vacuums as well. In addition, the invention provides that the vacuum cleaners described herein, including the exterior casings 10 thereof and their various components, may be comprised of various materials, such as plastics, metals, elastomers, and combinations of the foregoing.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A vacuum cleaner, which comprises a backpack accessory that is configured to be worn by a person, wherein the backpack accessory is affixed to an exterior casing that has a top half and a bottom half, wherein (a) a bottom half of an interior area of the casing houses a motor that is configured to generate a suction force; (b) the vacuum cleaner is configured to retain dirt particles, which are retrieved by the suction force, within a collection reservoir located within the casing; (c) the vacuum cleaner does not employ a disposable bag to capture and retain the dirt particles that the vacuum cleaner extracts from a surface, and (d) the vacuum cleaner further comprises a receiving plate that is configured to reversibly receive and be connected to the backpack accessory, wherein:

(i) the vacuum cleaner is configured to employ cyclonic separation of air and dirt within the interior area of the casing;

(ii) the motor is located at a bottom-most location of the interior area of the casing; and (iii) the vacuum cleaner further comprises an interior tube within the casing that is fluidly coupled to the motor, wherein the interior tube is configured to funnel air generated by the motor to and from a top interior portion of the casing; an internal cylinder disposed within the interior tube, wherein the internal cylinder is smaller in diameter compared to the interior tube and the internal cylinder is configured to funnel air that exits the interior tube back to the motor; one or more vents located at the top interior portion of the casing, which are configured to (x) receive air from the interior tube, (y) funnel the air in a circular motion, and (z) generate and impart a centrifugal force on dirt particles included within such air, around a top portion of the internal cylinder; and a filter disposed between the one or more vents and the internal cylinder, wherein the filter is positioned such that air must pass through the filter when exiting the one or more vents and before entering the internal cylinder.

2. The vacuum cleaner of claim 1, wherein:

(a) each vent exhibits a triangular cross-section;

(b) a first end of each vent is adjacent to a surface that extends around, and is perpendicular to, a central axis of the internal cylinder;

(c) a second end of each vent comprises an aperture through which air is funneled, wherein each vent is pointed in a same direction around the internal cylinder; and (d) each vent includes a top surface that exhibits a gradual slope away from the surface that extends around, and is perpendicular to, a central axis of the internal cylinder, wherein air that exits the aperture of a first vent is allowed to flow over the top surface of a neighboring second vent.

3. The vacuum cleaner of claim 2, wherein a top portion of the casing includes a clear window through which the filter may be visually inspected.

4. The vacuum cleaner of claim 1, wherein the receiving plate comprises a vibration damping material.

5. A vacuum cleaner, which comprises an exterior casing that has a top half and a bottom half, wherein (A) a bottom half of an interior area of the casing houses a motor that is configured to generate a suction force; (B) the vacuum cleaner is configured to retain dirt particles, which are retrieved by the suction force, within a collection reservoir located within the casing; and (C) the vacuum cleaner does not employ a disposable bag to capture and retain the dirt particles that the vacuum cleaner extracts from a surface, wherein (i) the vacuum cleaner is configured to employ cyclonic separation of air and dirt within the interior area of the casing and (ii) the motor is located at a bottom-most location of the interior area of the casing, wherein the vacuum cleaner further comprises:

(a) an interior tube within the casing that is fluidly coupled to the motor, wherein the interior tube is configured to funnel air generated by the motor to and from a top interior portion of the casing;

(b) an internal cylinder disposed within the interior tube, wherein the internal cylinder is smaller in diameter compared to the interior tube and the internal cylinder is configured to funnel air that exits the interior tube back to the motor;

(c) one or more vents located at the top interior portion of the casing, which are configured to (i) receive air from the interior tube, (ii) funnel the air in a circular motion, and (iii) generate and impart a centrifugal force on dirt particles included within such air, around a top portion of the internal cylinder; and (d) a filter disposed between the one or more vents and the internal cylinder, wherein the filter is positioned such that air must pass through the filter when exiting the one or more vents and before entering the internal cylinder.

6. The vacuum cleaner of claim 5, which comprises multiple vents located at the top interior portion of the casing, which are configured to receive air from the interior tube and funnel the air in a circular motion around a top portion of the internal cylinder.

7. The vacuum cleaner of claim 6, wherein:

(a) each vent exhibits a triangular cross-section;

(b) a first end of each vent is adjacent to a surface that extends around, and is perpendicular to, a central axis of the internal cylinder;

(c) a second end of each vent comprises an aperture through which air is funneled, wherein each vent is pointed in a same direction around the internal cylinder; and (d) each vent includes a top surface that exhibits a gradual slope away from the surface that extends around, and is perpendicular to, a central axis of the internal cylinder, wherein air that exits the aperture of a first vent is allowed to flow over the top surface of a neighboring second vent.

8. The vacuum cleaner of claim 7, wherein a top portion of the casing includes a clear window through which the filter may be visually inspected.

* * * * *